US008764244B2

(12) United States Patent
Jeon et al.

(10) Patent No.: US 8,764,244 B2
(45) Date of Patent: Jul. 1, 2014

(54) LIGHT MODULE AND MODULE TYPE LIGHTING DEVICE

(75) Inventors: Yongseog Jeon, Seoul (KR); Yongjin Kim, Seoul (KR); Jeongsoo Lee, Seoul (KR); Youngjae Cho, Seoul (KR); Moonsung Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 1 day.

(21) Appl. No.: 13/040,608

(22) Filed: Mar. 4, 2011

(65) Prior Publication Data

US 2011/0317425 A1 Dec. 29, 2011

(30) Foreign Application Priority Data

Jun. 23, 2010 (KR) ..... 10-2010-0059559

(51) Int. Cl.
*F21V 29/00* (2006.01)

(52) U.S. Cl.
USPC ..... 362/294; 362/373; 362/218; 362/246; 362/295

(58) Field of Classification Search
USPC ..... 362/249.02, 249.05, 294, 295, 264, 362/218, 373; 439/487
See application file for complete search history.

(56) References Cited

U.S. PATENT DOCUMENTS 1,456,585 A 5/1923 Bell
4,207,607 A 6/1980 Gulliksen
5,722,760 A * 3/1998 Chien ..... 362/84
5,940,269 A * 8/1999 Ko et al. ..... 361/697
6,331,063 B1 12/2001 Kamada et al.
6,367,949 B1 4/2002 Pederson
6,461,024 B1 10/2002 Becker et al.
6,599,002 B2 7/2003 Hsieh et al.
7,134,769 B2 11/2006 Rohlfing et al.
7,322,718 B2 1/2008 Setomoto et al.
7,404,658 B1 * 7/2008 Lyons et al. ..... 362/542
7,614,769 B2 * 11/2009 Sell ..... 362/365
7,628,513 B2 12/2009 Chiu (Continued)

FOREIGN PATENT DOCUMENTS

JP 2004-179048 6/2004
JP 2006-48165 2/2006

(Continued)

OTHER PUBLICATIONS

Office Action dated Mar. 22, 2012 for U.S. Appl. No. 13/016,310.

(Continued)

*Primary Examiner* — Jong-Suk (James) Lee
*Assistant Examiner* — Tsion Tumebo
(74) *Attorney, Agent, or Firm* — KED & Associates LLP

(57) ABSTRACT

A light module may include a base having a first side and a second side, and a light source on the first side of the base and having a light emitting diode (LED) to emit light in a direction away from the base. A plurality of cooling fins may be provided on the second side of the base, the plurality of cooling fins including a first set of fins having a first height and a second set of fins having a second height, wherein the first height is less than the second height. A driving circuit may be provided on the first set of cooling fins having the first height, wherein the first set of cooling fins are provided between the driving circuit and the second side of the base.

8 Claims, 3 Drawing Sheets

(56) References Cited

U.S. PATENT DOCUMENTS

| | | | | |
|---|---|---|---|---|
| 7,686,486 | B2 | 3/2010 | Tessnow et al. | |
| 7,780,317 | B2 | 8/2010 | Schroll et al. | |
| 7,821,380 | B1 * | 10/2010 | Grote, Jr. | 340/384.4 |
| 7,988,335 | B2 | 8/2011 | Liu et al. | |
| 8,042,969 | B2 | 10/2011 | Paik et al. | |
| 8,052,301 | B2 * | 11/2011 | Zhou et al. | 362/249.02 |
| 8,087,807 | B2 * | 1/2012 | Liu et al. | 362/373 |
| 8,206,015 | B2 | 6/2012 | Cho et al. | |
| 2002/0024822 | A1 | 2/2002 | Pond et al. | |
| 2004/0066142 | A1 | 4/2004 | Stimac | |
| 2005/0128752 | A1 | 6/2005 | Ewington | |
| 2006/0044806 | A1 | 3/2006 | Abramov et al. | |
| 2006/0092641 | A1 | 5/2006 | Phelan et al. | |
| 2008/0078524 | A1 | 4/2008 | Wilcox et al. | |
| 2008/0080162 | A1 * | 4/2008 | Wilcox et al. | 362/20 |
| 2008/0123331 | A1 | 5/2008 | Schroll et al. | |
| 2009/0003009 | A1 | 1/2009 | Tessnow et al. | |
| 2009/0129102 | A1 | 5/2009 | Xiao et al. | |
| 2009/0141508 | A1 | 6/2009 | Peng et al. | |
| 2009/0184619 | A1 | 7/2009 | Lai | |
| 2009/0290352 | A1 | 11/2009 | Wu et al. | |
| 2010/0214788 | A1 | 8/2010 | Kadono et al. | |
| 2011/0063832 | A1 * | 3/2011 | Hu et al. | 362/235 |
| 2011/0110046 | A1 | 5/2011 | Itoh et al. | |
| 2011/0181167 | A1 | 7/2011 | Cho et al. | |
| 2011/0194282 | A1 | 8/2011 | Paik et al. | |
| 2011/0317412 | A1 | 12/2011 | Paik et al. | |
| 2011/0317428 | A1 | 12/2011 | Paik et al. | |
| 2012/0001531 | A1 | 1/2012 | Cho et al. | |
| 2012/0002424 | A1 | 1/2012 | Cho et al. | |
| 2012/0026740 | A1 | 2/2012 | Kim et al. | |
| 2012/0033423 | A1 | 2/2012 | Kim et al. | |
| 2012/0074835 | A1 | 3/2012 | Piquette et al. | |
| 2012/0106152 | A1 * | 5/2012 | Zheng et al. | 362/249.02 |
| 2012/0106167 | A1 | 5/2012 | Chang | |
| 2012/0120667 | A1 | 5/2012 | Schenkl | |
| 2012/0176801 | A1 | 7/2012 | You | |

FOREIGN PATENT DOCUMENTS

| | | |
|---|---|---|
| JP | 2009-048994 | 3/2009 |
| KR | 20-0353040 | 6/2004 |
| KR | 10-2006-0086177 | 7/2006 |
| KR | 10-2006-0104501 | 10/2006 |
| KR | 10-0695542 | 3/2007 |
| KR | 10-2007-0044022 | 4/2007 |
| KR | 10-0715039 | 5/2007 |
| KR | 2008-0020614 | 3/2008 |
| KR | 20-2008-0002564 | 7/2008 |
| KR | 10-2008-0093284 | 10/2008 |
| KR | 10-2009-0004569 | 1/2009 |
| KR | 10-2009-0042679 | 4/2009 |
| KR | 10-0896381 | 4/2009 |
| KR | 20-2009-0004396 | 5/2009 |
| KR | 2009-0097055 | 9/2009 |
| KR | 20-0447377 | 1/2010 |
| KR | 10-2010-0026422 | 3/2010 |
| KR | 10-2010-0030683 | 3/2010 |
| KR | 10-2010-0035934 | 4/2010 |
| KR | 10-2010-0055320 | 5/2010 |
| KR | 10-2010-006685 | 6/2010 |
| KR | 10-2010-0064800 | 6/2010 |
| KR | 10-2010-0066685 | 6/2010 |
| KR | 10-0967946 | 7/2010 |
| KR | 10-2011-0029915 | 3/2011 |
| WO | WO 2009/065389 | 5/2009 |

OTHER PUBLICATIONS

Office Action dated Oct. 27, 2011 for U.S. Appl. No. 13/099,890.

Notice of Allowance dated Feb. 21, 2012 for U.S. Appl. No. 13/099,890.

Korean Prior Art Search Report for Application 10-2010-0062951 dated Mar. 31, 2011.

Korean Office Action for Application 10-2010-0062951 dated Apr. 22, 2011.

Korean Office Action for Application 10-2010-0059559 dated Apr. 15, 2011.

Korean Prior Art Search Report for Application 10-2010-0059559 dated Mar. 30, 2011.

Korean Prior Art Search Report for Application 10-2010-0063728 dated Mar. 31, 2011.

Office Action for U.S. Appl. No. 13/016,310 dated Sep. 18, 2012.

European Search Report for Application 11159284.6 dated Sep. 12, 2012.

Korean Notice of Allowance for Application 10-2010-0059559 dated Jul. 11, 2011.

Korean Notice of Allowance for Application 10-2010-0062951 dated Jul. 28, 2011.

U.S. Office Action for U.S. Appl. No. 13/081,023 dated Apr. 3, 2013.

U.S. Office Action dated Aug. 14, 2013 for U.S. Appl. No. 13/016,310.

* cited by examiner

LIGHT MODULE AND MODULE TYPE LIGHTING DEVICE

CROSS-REFERENCE TO RELATED APPLICATIONS

This application claims priority from Korean Patent Application No. 10-2010-0059559, filed Jun. 23, 2010, the subject matter of which is hereby incorporated by reference.

BACKGROUND

1. Field

Embodiments may relate to a lighting device.

2. Background

An electric lighting device may include a light source to emit light upon application of electricity thereto. The light source may emit heat as well as the light.

Usage of a light emitting diode (LED) has been recently rapidly increased. LED lighting devices may consume relatively less power, and thus are getting used more.

A LED lighting device may use one or more than one LED as the light source. Heat generated by the LEDs may have a negative influence on a lifespan of the LED. The LED lighting device may include a heat sink (or housing) to absorb the heat from the LED and emit to outside of the LED lighting device.

A module type lighting device may have a plurality of light modules. The module type lighting device may illuminate a wider space.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
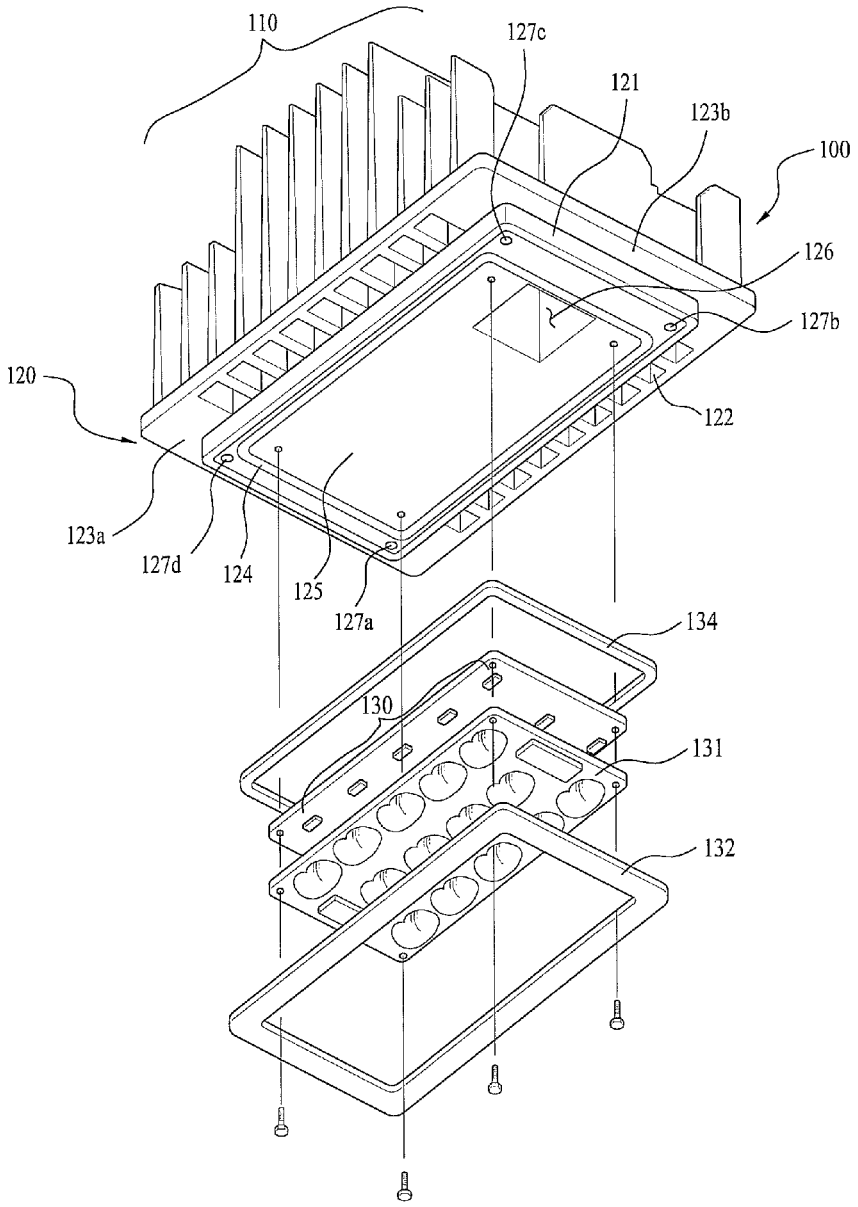
FIG. 1 is an exploded perspective view of a light module of a module type lighting device in accordance with an example embodiment.

FIG. 1 is an exploded perspective view of a light module of a module type lighting device in accordance with an example embodiment. Other embodiments and configurations may also be provided.

FIG. 1 shows a light module 100 that includes a plurality of cooling fins 110 and a base 120. The base 120 and the plurality of cooling fins 110 may be integrally formed as one piece. The cooling fins 110 may extend from an upper surface (or side) of the base 120. Air may flow through spaces between the cooling fins 110. The spaces between the cooling fins 110 may serve as horizontal air passages. The cooling fins 110 may be considered as a heat sink (or housing) or as part of a heat sink (or housing).

A plurality of holes 122 (or through-holes) may be provided on the base 120 and extend in a vertical direction from an upper surface (or side) of the base 120 to a lower surface (or side) of the base 120. The holes 122 may be arranged on the base 120 at areas that correspond to spaces between the cooling fins 110. The spaces above and below the base 120 are in air flow communication with each other via the holes 122. Therefore, air may vertically flow via the holes 122. That is, the base 120 may have vertical air passages due to the holes 122.

The vertical direction and the horizontal direction may be described with respect to a specific example where the lighting device is installed so as to illuminate light downward. In this installation, the vertical direction may correspond to a light emitting direction, and the horizontal direction may correspond to a direction transverse to the light emitting direction. Other installment directions may also be provided.

The holes 122 may be an approximately rectangular shape and may be closed at side surfaces. The holes 122 are not limited to a specific shape. Some of the side surfaces of the holes 122 may be shaped as open. For example, the holes 122 may be open at one side adjacent to the edge of the base 120. The holes 122 may be C-shaped, for example.

A wall 121 may vertically extend from a lower surface (or side) of the base 120. The wall 121 may be inwardly spaced from edges of the base 120. A light source 130 may be provided in a space that is surrounded by the wall 121. The light source 130 may include a plurality of light emitting diodes (LEDs) on a printed circuit board (PCB).

A surface inside the wall 121 may be recessed, and the PCB of the light source 130 may be located at an approximate center of the recessed portion. The PCB may be surrounded by the wall 121. The recessed portion may include a groove 124 that surrounds the PCB. A sealer 134 may also be provided in the groove 124.

A window 131 may be coupled to the base 120 with a tight contact with the sealer 134. The window 131 may include a plurality of light concentration window portions each of which may correspond to a corresponding one of the LEDs. The window 131 may be coupled to a bottom of the recessed portion of the base 120 by screws, for example. The base 120 may have fastening holes 127*a*, 127*b*, 127*c*, and 127*d*. The window 131 may be attached at its both ends such that the sealer 134 is between the attached ends. A cover 132 that covers a circumferential surface of the window 131 may also be attached.

The base 120 and the cooling fins 110 may be made of a metal material having good heat-transfer properties. The base 120 and the cooling fins 110 may be made of aluminum by die-casting. The cooling fins 110 may be considered a heat sink.

The base 120 may also include a pair of sitting portions 123*a*, 123*b* to be seated on and supported by a frame. The sitting portions 123*a*, 123*b* may be provided opposite to each other with respect to the light source 130.

The wall 121 may prevent the window 131 and the light source 130 from being damaged by a frame when the light module 100 is provided on the frame (or is coupled to a frame).

A channel 126 that communicates with the outside may be formed through a part 125 of the recessed portion of the base 120. The light source 130 may be electrically connected with a driving circuit through the channel 126.

Although FIG. 1 illustrates an embodiment having the vertical wall 121, the vertical wall 121 may not be provided. That is, the recessed portion of the base 120 may be formed on one surface of the base 120 without the vertical wall 121, and the light source 130 may be located on the recessed portion of the base 120.

The base 120 may be one piece integrally formed by die-casting. The base 120 may also be formed and assembled with a separately provided base 120 and cooling fins 110.

Figure 2:
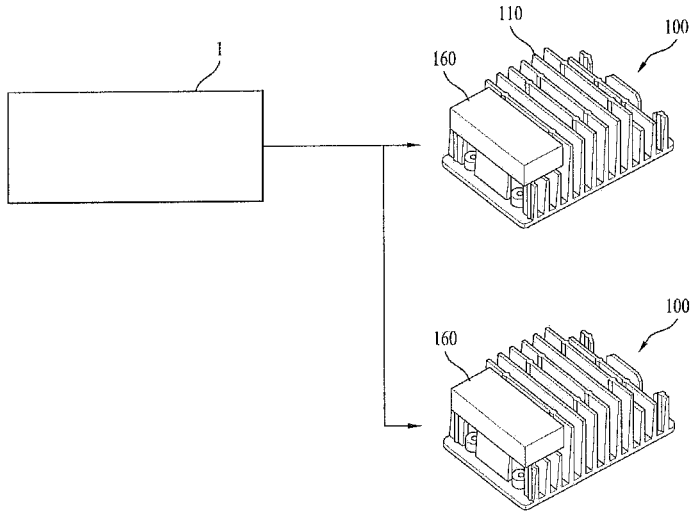
FIG. 2 is a view illustrating driving circuits assembled with respective light modules in accordance with an example embodiment.

FIG. 2 illustrates an example embodiment in which a single light module includes a driving circuit. Other embodiments and configurations may also be provided. As shown in FIG. 2, a driving circuit 160 may be provided on the light module 100 and may be detachable with respect to the light module 100. As shown in FIG. 2, each light module 100 includes a separate driving circuit 160. For ease of discussion, examples may be described with respect to a single light module having its respective driving circuit.

The driving circuit 160 may be located on an external surface of the body 120 such that the driving circuit 160 is separated from the PCB of the light source 130. The driving circuit 160 may be electrically connected only to the PCB through electrical connection means, such as by using wires.

The driving circuit 160 may be located on several of the cooling fins 110 as shown in FIG. 2. FIG. 2 shows that the cooling fins 110 may include a first set of low fins and second set of high fins that each extend away from the base 120. The driving circuit 160 may be provided on the first set of the cooling fins 110 having the low height (without being provided on the second set of the cooling fins 110 having the high fins). The driving circuit 160 may not protrude over the second set of the cooling fins 110 having the high height. The height of the cooling fins 110 may be based on a height of the cooling fins 110 from the base 120.

The driving circuit 160 may be electrically connected to the PCB of the light source 130. More specifically, the driving circuit 160 and the PCB of the light source 130 may be connected by electric wires through the channel 126.

The driving circuit 160 may also be electrically connected with a main power supply 1 by electric wires, for example. As shown in FIG. 2, each driving circuit 160 (from each separate light module 100) may be separately electrically connected to the power supply 1.

The driving circuit 160 may be detachably attached to the respective light module 100. The driving circuit 160 and the light module 100 may be easily detached from each other.

Figure 3:
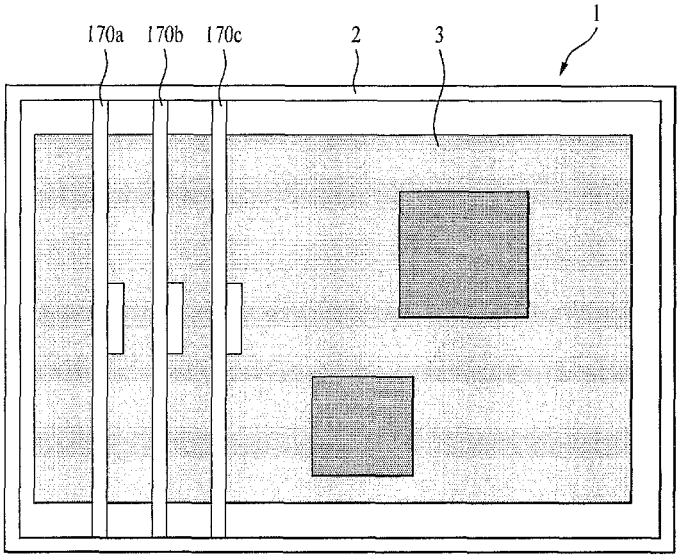
FIG. 3 is a view illustrating driving circuits assembled with a main power supply in accordance with an example embodiment.

FIG. 3 illustrates driving circuits assembled with a main power supply in accordance with an example embodiment. Other embodiments and configurations may also be provided. More specifically, FIG. 3 shows driving circuits 170*a*, 170*b*, 170*c* that are detachably attached to the main power supply 1.

The main power supply 1 may include a case 2 and a circuit board 3 within the case 2. The circuit board 3 may include an AC-DC converter, for example. The driving circuits 170*a*, 170*b*, 170*c* may be connected to the circuit board 3 by an electrical pin-and-slot mechanism. For example, the circuit board 3 may include a plurality of slots, and the respective driving circuits 170*a*, 170*b*, 170*c* may be inserted into the slots such that the driving circuits 170*a*, 170*b*, 170*c* are electrically connected to the circuit board 3. The driving circuits 170*a*, 170*b*, 170*c* may be circuit boards, each of which may have a circuit to drive the light module(s) 100.

As one example, the driving circuits 170*a*, 170*b*, 170*c* may include a constant-current circuit to supply a constant current to a respective light module.

The driving circuits 170*a*, 170*b*, 170*c* may include specific circuits to drive the light modules. For example, the driving circuits 170*a*, 170*b*, 170*c* may include a dimming circuit and/or a circuit for turning on and off the light source with a timed pattern. The driving circuits 170*a*, 170*b*, 170*c* may include other circuits associated with driving of the light module.

Figure 4:
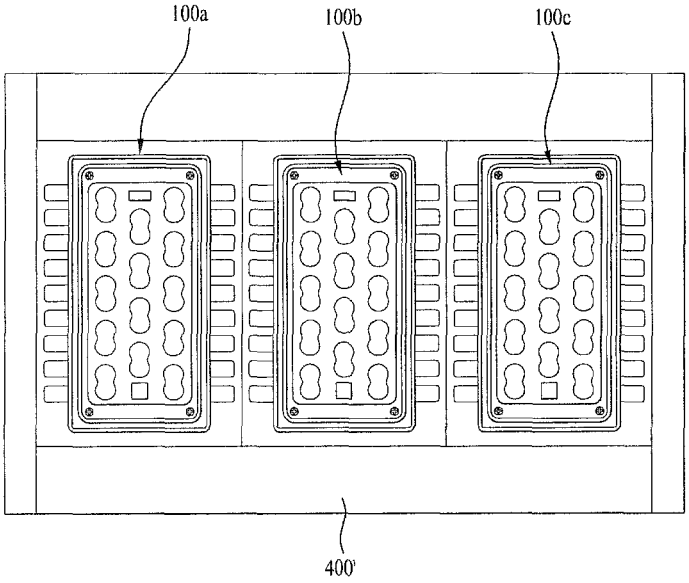
FIG. 4 is a view of a module type lighting device in accordance with an example embodiment.

FIG. 4 is a view of a module type lighting device in accordance with an example embodiment. Other embodiments and configurations may also be provided.

FIG. 4 specifically shows a plurality of light modules 100*a*, 100*b*, 100*c* provided with a frame 400. Other numbers of light modules may be provided within a specific frame. The frame 400 may support each of the plurality of light modules 100*a*, 100*b*, 100*c*.

A module type lighting device may include a plurality of light modules, and a plurality of driving circuits to drive the respective light modules. The driving circuits may be individually detachable to the lighting device.

The light modules may also be detachable to the lighting device.

In the module type lighting device, as the number of the light modules changes, the number of the driving circuits may also change.

A driving pattern for a specific light module may be changed by changing the corresponding driving circuit to another driving circuit. In this example, the corresponding driving circuit may not necessarily be changed. However, if necessary or desired, the light module may also be replaced.

The plurality of light modules may be individually and detachably assembled with one frame.

The plurality of driving circuits may electrically connect the respective light modules to a main power supply. The main power supply may not be necessarily limited to a single main power supply. There may be more than one main power supply.

The driving circuits may control current or power supplied to the light modules. For example, each driving circuit may include a constant-current circuit to supply constant current to the corresponding light module.

The driving circuits may include same driving circuits such that all of the light modules are controlled in a same pattern. Alternatively, some or all of the driving circuits may be different to control the corresponding light modules differently from each other.

If one of the light modules is out of order, then the light module may be replaced with a new light module. Further, a driving pattern may be changed for a specific light module by simply changing the corresponding driving circuit.

The driving circuits may be detachably connected to the main power supply.

The driving circuits may be located on the light modules so as to be detachable together with the light modules. The driving circuits may be detachably connected to the corresponding light modules.

The driving circuits may include a constant-current circuit, a dimming circuit, or a circuit for turning on and off the light source with a timed pattern.

The light modules may have an air passage in a light emitting direction of its light source and an air passage in a direction transverse to the light emitting direction. For the light emitting direction passage, through-holes may be provided around the light source.

The light module may include a base (or body) to hold a light source, which has a heat sink (or housing) to emit heat generated from the light source. The light module may include a driving circuit to connect the light source to a power supply and drive the light source. The driving circuit may be detachably attached to the base. The driving circuit may be easily separated from the base. By detaching and changing the driving circuit, the driving pattern may be easily changed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A module type lighting device comprising:

a power supply that includes a case and a circuit board within the case;

a frame; and a plurality of light modules provided on the frame, each light module being individually detachable from the frame, each light module including:

a base having a first side and a second side, a plurality of through-holes provided on the base to extend in a vertical direction from the first side of the base to the second side of the base, a wall extended from the first side of the base, a light source on the first side of the base and having a light emitting diode (LED) to emit light in a direction away from the base, the light source disposed inside the wall, a sealer provided in the wall, a window coupled to the base with a contact with the sealer and to cover the light source, a cover to cover a circumferential surface of the window, a heat sink having a plurality of cooling fins on the second side of the base, a driving circuit to electrically connect the power supply to each light module, the driving circuit being detachably coupled to the light module or the power supply; and a channel that passes through the base, wherein the light source is electrically connected to the driving circuit through the channel, wherein the driving circuit is a constant-current circuit, wherein the circuit board of the power supply includes an AC-DC converter, wherein the plurality of through-holes are arranged on the base at areas that correspond to spaces between the cooling fins, wherein air flows through spaces via the plurality of through-holes, wherein the plurality of cooling fins includes a first set of cooling fins and a second set of cooling fins, the first set of cooling fins having a lower height than the second set of cooling fins, wherein the driving circuit is provided on the first set of cooling fins, and wherein the driving circuit is provided over the first set of cooling fins without being provided over the second set of cooling fins.

2. The module type lighting device of claim 1, wherein the light source includes a circuit board, and the driving circuit is separate from the circuit board of the light source.

3. The module type lighting device of claim 1, wherein the driving circuit further includes a dimming circuit, or a circuit for turning on and off the light source with a timed pattern.

4. A module type lighting device comprising:

a power supply that includes a case and a circuit board;

a frame; and a plurality of light modules on the frame, each light module being individually detachable from the frame, wherein at least one light module includes:

a base having a first side and a second side, a plurality of through-holes at the base that extend from the first side of the base to the second side of the base, a wall extended from the first side of the base, a light source at the first side of the base and having a light emitting diode (LED) to emit light away from the base, the light source being inside the wall, a sealer at the wall, a window coupled to the base to cover the light source, a cover to cover a surface of the window, a first set of cooling fins and a second set of cooling fins on the second side of the base, the first set of cooling fins having a lower height than the second set of cooling fins, a driving circuit to electrically connect the power supply to each of the plurality of light modules, the driving circuit being detachably coupled to at least one of the light modules or the power supply, wherein the driving circuit is provided over the first set of cooling fins without being provided over the second set of cooling fins, and a channel that passes through the base, wherein the light source is electrically connected to the driving circuit through the channel, wherein the plurality of through-holes are at the base at areas corresponding to spaces between the cooling fins, wherein air flows through the spaces via the plurality of through-holes.

5. The module type lighting device of claim 4, wherein the driving circuit is a constant-current circuit, and wherein the circuit board of the power supply includes an AC-DC converter.

6. The module type lighting device of claim 4, wherein the light source includes a circuit board, and the driving circuit is separate from the circuit board of the light source.

7. The module type lighting device of claim 4, wherein the driving circuit includes a dimming circuit.

8. The module type lighting device of claim 4, wherein the driving circuit includes a circuit for turning on and off the light source with a timed pattern.

* * * * *